US005896722A

United States Patent [19]

Swenson

[11] Patent Number: 5,896,722

[45] Date of Patent: Apr. 27, 1999

[54] WELDLESS SPACER

[76] Inventor: Richard A. Swenson, 760 Norman Dr., Ridgewood, N.J. 07450

[21] Appl. No.: 09/136,601

[22] Filed: Aug. 19, 1998

[51] Int. Cl.[6] ..... E04C 5/16

[52] U.S. Cl. ..... 52/712; 52/719; 403/391; 404/134

[58] Field of Search ..... 52/712, 719, 685, 52/686; 403/392, 400, 389, 391; 404/134, 135, 136

[56] References Cited

U.S. PATENT DOCUMENTS

| | | | |
|---|---|---|---|
| 517,484 | 4/1894 | Ruckman et al. | 403/392 |
| 1,084,389 | 1/1914 | Blackmore | 52/712 |
| 1,621,184 | 3/1927 | White | 404/136 |
| 1,750,106 | 3/1930 | Heltzel | 404/135 |
| 1,830,888 | 11/1931 | Ribb | 404/135 |
| 2,843,230 | 7/1958 | Nelsson | 52/719 |
| 3,257,767 | 6/1966 | Lassy | 52/712 |
| 3,356,399 | 12/1967 | Young | 52/712 |
| 3,722,164 | 3/1973 | Schmiogall | 52/719 |
| 4,999,965 | 3/1991 | Schmidgall et al. | 52/684 |
| 5,181,363 | 1/1993 | Leach et al. | 52/719 |
| 5,832,690 | 11/1998 | Kaines | 52/712 |

OTHER PUBLICATIONS

Catalog for Spacers and Reinforcement Accessories for Concrete Products, Hawkeye Group, Mediapolis, Iowa, circa 1994.

Catalog page for "Stirrup Spacers"—Eastern States Steel Corporation (admitted prior art).

Catalog page for "Box Section Spacers"—Eastern States Steel Corporation (admitted prior art).

*Primary Examiner*—Michael Safavi

*Attorney, Agent, or Firm*—Baker & Botts, L.L.P.

[57] ABSTRACT

A weldless spacer for manually connecting without a tool two reinforcement cage wires or re-bars of a concrete reinforcing structure in spaced-apart relation is a unitary resilient wire member that has an elongated spanning portion that extends between the reinforcement wires, a hook end portion at one end of the spanning portion, and a fastening end portion at the other end of the spanning portion. The hook end portion includes a detent part and a V-hook part, which are joined by a spacer loop part and capture one of the reinforcement wires. The fastening end portion includes a detent part and a J-hook part, which are joined by a spacer loop part and capture the other reinforcement wire. One or both of the spacer loops are sized to space the reinforcement wire(s) at a desired distance(s) from the adjacent concrete form wall(s) for sufficient concrete cover.

17 Claims, 3 Drawing Sheets

WELDLESS SPACER

TECHNICAL FIELD OF THE INVENTION

The present invention relates generally to weldless spacers and, more particularly, to weldless spacers of the type used to manually join adjacent reinforcement wires or re-bars in concrete structures, such as the inner and outer cages of welded steel wire reinforcement for precast reinforced concrete box sections for culverts, storm drains and sewers double cage round pipe and for reinforced concrete walls.

BACKGROUND OF THE INVENTION

Precast reinforced concrete structures of the type having double reinforcing cages of welded steel wire reinforcement use spacers to connect the inner and outer reinforcement cages at a predetermined spacing from each other and to hold the interconnected cages at predetermined spacings from the inner or outer form or from both the inner and outer forms so as to provide the required cover of concrete over the steel wire reinforcement cages. One type of spacer, which is generally called a box spacer, is a length of steel wire that is bent at each end to form a shallow seat for the oppositely located wires of the inner and outer reinforcement cages and, outwardly of each wire seat, a spacer loop. The box spacer straddles the two cage wires that it connects, the cage wires being located inwardly of the spacer loops.

An adaptation of the aforementioned box spacer is a stirrup spacer used in double cage reinforced round pipe, wherein the inner reinforcement cage is formed into a hoop of the required diameter and is geometrically stable. The outer reinforcement cage is pre-curved to a relaxed (unloaded) diameter greater than its final diameter. When the stirrup spacers are installed, the outer cage is pre-stressed such as to pull the wires of the outer cage inwardly into the outer seats of the spacers. The resiliency and tension between the circumferential wires of the inner and outer cages keeps the circumferential wires that are connected by the stirrup spacers from displacing toward the wires of the other cage. It is, therefore, not necessary to separately fasten the stirrup spacers to the cages, such as by welding or by tie wires.

When box spacers are used for precast reinforced concrete box sections, it is necessary to secure the wires of the inner and outer reinforcement cages to the spacers to prevent the cages from being displaced from their seats toward each other when the concrete is poured. One way of doing that is by welding the box spacers to the two cages. Welding is laborious and costly and is sometimes not permitted under the specifications for the product, inasmuch as welding weakens both the wires of the reinforcement cages and the spacers. When welding is not permissible, small soft tie wires are used at the juncture between each spacer and each reinforcing cage wire. Tie wires also require additional labor and, because they are relatively weak, can fail and allow displacements of the reinforcement cages toward each other during pouring of the concrete.

U.S. Pat. No. 4,999,965 ("the '965 patent") describes and shows a weldless spacer for the reinforcements of double cage reinforced concrete products. The spacer of the '965 patent, which is commercially available, is a length of spring steel wire that has a shallow wire-spacing loop at each end of a straight bridging or spanning portion that extends between the inner and outer reinforcement cages (the opposite wires of the reinforcement cages nest in such wire-spacing loops) a form-spacing loop outwardly of each wire-spacing loop with respect to the spanning portion, and a retainer hook that is bent back from the form-spacing loop and hooks onto the cage wire. Each wire-spacing loop overlies the wire, and each retainer hook underlies the wire. The wire-spacing loops are offset from the retainer hooks longitudinally of the wires of the reinforcement cages to which the spacer is connected.

The '965 patent spacer is installed by laying it obliquely to one of the wires of a reinforcement cage and hooking one end to that wire, pivoting the spacer so that it lies nearly perpendicular to the two reinforcement wires, and prying the still unhooked end with a tool placed between the wire-spacing loop and the retainer hook to twist the retainer hook outwardly and downwardly so that it can be forcibly pried into place under the cage wire. Setting the retainer hook requires prying the hook outwardly by expanding and laterally deflecting the form-spacer loop. A relatively large force is required, because there is very little leverage distance afforded by the form-spacing loop. It is easy for the tool to slip from the retainer hook when the installer is trying to secure the hook, thus releasing the stress and allowing the unhooked end to spring free violently. The spacer can strike the user's hands or body if he is not careful. The need to use a tool and to apply a very large torsional force to the hook makes installation very strenuous and hazardous.

SUMMARY OF THE INVENTION

An object of the present invention is to provide a weldless spacer that can be installed manually—i.e., by hand without any tools—and which requires very little force to be applied to it when it is being installed. Another object is to reduce the costs of producing concrete structures, and precast concrete structures in particular, by eliminating welding or tie-wiring the reinforcement wires to the spacers and by providing weldless spacers that are relatively inexpensive and that can be installed very quickly, thus saving time and labor costs when the wire reinforcement is being assembled within the molds. It is also an object to provide a weldless spacer that remains securely in position after installation and especially when the concrete is being poured into the mold.

Although the spacer of the invention has particular application in the securement and placement of wire reinforcement cages in precast concrete structures, it also has utility in concrete structures that are reinforced with steel reinforcing bars, known as re-bars, which are typically thicker than wire. Unless otherwise stated, therefore, the terms "wire reinforcement", "reinforcement wire", etc., as used herein, whether or not in reference to cages, are intended to encompass both wire and re-bars.

Also, throughout the present specification and the appended claims, the terms "outwardly" and "inwardly" are used with reference to the center of the space between two reinforcing wires being joined by the spacer. The terms "upwardly," "downwardly" and "laterally" are used, as a matter of convenience, to identify relationships among elements.

The objects referred to above are attained, in accordance with the present invention, by a weldless spacer for connecting a first reinforcement wire and a second reinforcement wire of a concrete reinforcement structure in spaced-apart relation. The spacer is a unitary resilient wire member that has an elongated spanning portion adapted to extend between the reinforcement wires, a hook end portion at one end of the spanning portion, and a fastening end portion at the other end of the spanning portion. The hook end portion includes a detent part that is curved to form a groove at a juncture with the spanning portion so as to engage upwardly, outwardly and downwardly facing surfaces of the first reinforcement wire at a first location along the first reinforcement wire, a V-hook part shaped and positioned to form a groove so as to engage upwardly, inwardly and downwardly facing surfaces of the first reinforcement wire at a second location along the first reinforcement wire spaced apart laterally to one side with respect to the spanning portion, and a loop part joining the detent part and the V-hook part. The fastening end portion includes a detent part curved to form a groove at a juncture with the spanning portion so as to engage upwardly, outwardly and downwardly facing surfaces of the second reinforcement wire at a first location, a J-hook part shaped and positioned to form a groove so as to engage upwardly, inwardly and downwardly facing surfaces of the second reinforcement wire at a second location along the second reinforcement wire spaced apart laterally to said one side with respect to the spanning portion, and a loop part joining the detent part and the J-hook part.

When the spacer is installed on the two reinforcement wires being joined, the detent parts of both the hook end portion and the fastening end portion engage generally outwardly facing surfaces of the respective reinforcement wires and prevent the wires from moving away from each other. The detent portions also retain the spacer in engagement with the upper surfaces of the reinforcement wires by virtue of engaging downwardly facing surfaces of the spacer. The V-hook part and J-hook part of the spacer engage the inward sides of the reinforcement wires, thus keeping each wire from moving toward the other wire. The V-hook part and J-hook part also engage upwardly and downwardly facing surfaces of the reinforcement wires, which are thus captured against vertical movements of the wires relative to the spacer.

When the weldless spacer is completely attached to the inner and outer reinforcement wires, the V-hook wedges and locks onto the inner reinforcement wire and prevents rotation of the weldless spacer off the reinforcement wires to which it is attached. This V-hook rotational constraint prevents accidental detachment of the weldless spacer from either the inner or outer or both of the reinforcement wires.

As is discussed more fully in the detailed description of a preferred embodiment set forth below, an important aspect of the invention is that both the detent portions and the hook portions of the hook end and the fastener end of the spacer hook over the upper surfaces of the inner and outer reinforcement wires. Therefore, it is not necessary to pry open the loop of the fastener end to install the fastener end. Instead, the fastener end is displaced laterally of the wire that receives it, e.g., the outer cage reinforcement wire, and laterally relative to the hook end, thus positioning the spanning portion obliquely to the reinforcement wire and presenting in lateral profile a wider gap or throat at the fastener end between the detent part and the J-hook part and permitting the fastener end to be pushed down into place onto the outer reinforcement wire. Bending of the spanning portion and resilient constriction of the spacer loop part of the V-hook end portion of the spacer permit the spacer to be skewed to the outer reinforcement wire with a relatively small force. After the fastener end is pushed down into place onto the outer reinforcement wire, the fastener end is moved so as to pivot the spacer about the V-hook end until the spanning portion lies substantially perpendicular to both the inner and outer reinforcement wires.

In preferred embodiments, the J-hook part of the fastening end portion includes a serpentine distal end leg part, the tip of which forms a camming surface that is adapted to engage an inner surface of the second reinforcement wire and facilitate reception of the second reinforcement wire into the groove of the J-hook part by aiding in causing lateral deflection of the spacer's fastening end and resilient constriction of the spacer loop portion of the fastener end. When the spacer is installed on the reinforcement wires, the detent part and V-hook part of the hook end portion form in lateral profile a throat having an entrance that is narrower than the thickness of the first reinforcement wire. Similarly, the J-hook part and detent part of the fastening end portion form in profile a throat having an entrance that is narrower than the lateral thickness of the second reinforcement wire. The spacer loop portions are resiliently stressed so as to fictionally engage the detent parts and the V-hook and J-hook parts with the reinforcement wires and retain the spacer against displacement along the reinforcement wires.

The V-hook part of the hook end portion may have first and second legs forming an angle of from about 30 degrees to about 60 degrees and a rounded portion joining the legs. A "V" shape is conducive to receiving reinforcement wires of different wire gages, the smallest gage reinforcement wire being fully seated in the rounded portion and larger gages being accepted in slightly spaced apart relation to the rounded portion. The V-hook part may, alternatively, be dimensioned specifically for a given gage wire, in which case different spacers are provided for each wire reinforcement of a different gage for any given spacing of the inner and outer reinforcement wires.

The loop parts of the hook end and fastener end portions are, preferably, substantially smoothly curved in profile. Smoothly curved loop parts are easier to form, as compared to loops composed of straight and curved segments, which are, however, also possible. Ordinarily, but not necessarily, the outer extremities of the loop portions of the spacer engage the inner and outer forms in which a precast product is produced, thus controlling the thickness of the cover of concrete over the inner and outer reinforcement wires. It is possible, also, for only the outer loop portion to engage the outer form, the inner loop portion being in clearance from the inner form and vice versa.

DESCRIPTION OF THE DRAWINGS

For a more complete understanding of the present invention, and the advantages thereof, reference may be made to the following description of an exemplary embodiment, taken in conjunction with the accompanying drawings, in which.

DESCRIPTION OF A PREFERRED EMBODIMENT

Figure 1:
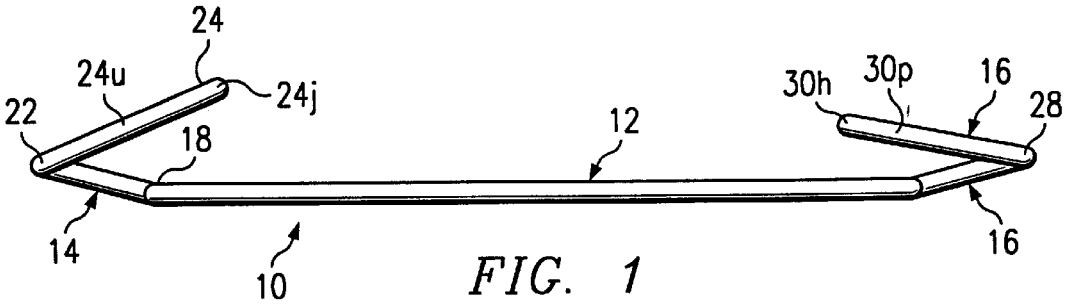
FIG. 1 is a top plan view of one embodiment of a spacer in accordance with the invention.

A preferred embodiment of a spacer, according to the present invention, is shown in the drawings that is designed for use in joining the inner and outer cages of welded steel wire reinforcement in precast reinforced concrete structures, such as box sections to ASTM designation C789-87, which are widely used for culverts, storm drains, box sections and sewers for non-highway installations, and to ASTM Designation C850-87, which are subject to highway loading and a relatively small earth cover between the top of the box section and the road or other surface. The spacer can also be used for the reinforcement cages of round precast concrete pipe such as is shown in ASTM Designation C76-85 and in any reinforced structure in which wire reinforcement re-bar cages are to be connected in spaced-apart relation.

The spacer is a length of a spring steel wire 10 having a usual diameter of about 3/16th inch, but more or less as required, that is bent at each end to form at one end of a straight spanning portion 12 a hook end portion 14 and at the other end of the spanning portion 12 a fastener end portion 16. The hook end portion 14 originates at a juncture 18 with the spanning portion as a relatively small radius downward bend through an arc of a little more than 90 degrees such as to form a shallow detent part 20, the lower portion of which partly underlies one of the reinforcement wires being joined. A loop part 22, in which the wire is bent in the reverse direction from the detent part 20 through an arc of about 120 degrees, joins the detent part 20 to a V-hook part 24. The loop portion 22 also bends laterally with respect to the spanning portion 12, thus locating the V-hook part 24 in laterally spaced-apart relation to the detent part 20.

The V-hook part has an upper leg **24*u* and a lower leg 24*l*, which are joined at a rounded juncture 24*j* and which form an included angle of from about 30 degrees to about 60 degrees. The "V" shape of the V-hook part 24 permits the same spacer to be used with reinforcing wire cages having wires of different gages. The smallest wire nests in the rounded juncture 24*j*; larger wires nest in slightly spaced apart relation to the juncture, i.e., outwardly along the legs 24*u* and 24*l*. The V-hook part 24** may, however, be sized and shaped for a particular gage wire, in which case the spacers are produced in a range of sizes for each desired spacing between the inner and outer reinforcement cages.

When the weldless spacer 10 is completely attached to the inner and outer cage reinforcement wires, the V-hook 24 wedges and locks onto reinforcement wire W1 (see FIG. 5A) and prohibits rotation of the spacer about either cage wire W1 or W2, thereby preventing detachment of the spacer from the wires W1 and W2.

Figure 2:
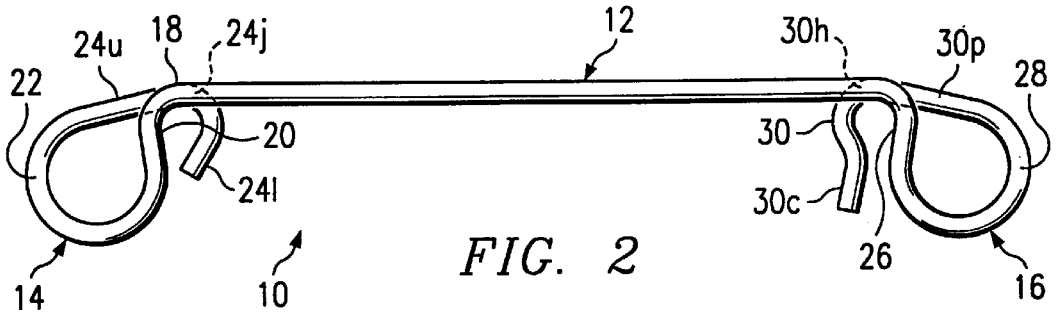
FIG. 2 is a front elevational view of the embodiment.
Figure 3:
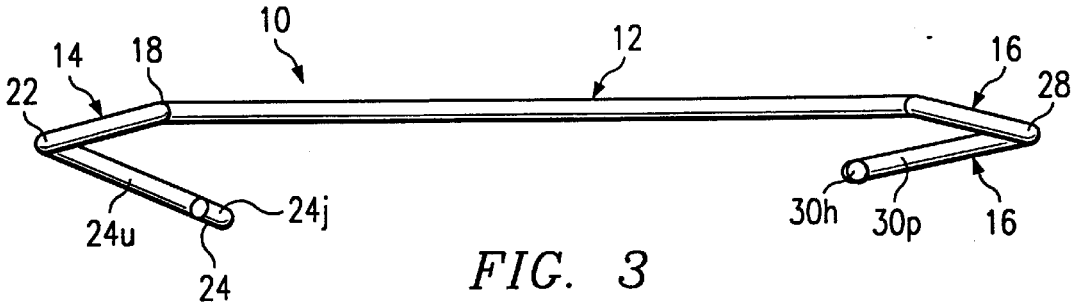
FIG. 3 is a bottom plan view of the embodiment.
Figure 4:
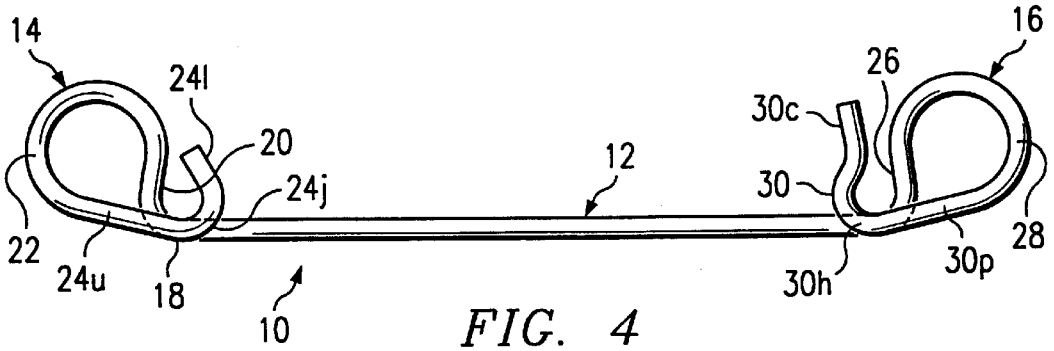
FIG. 4 is a rear elevational view of the embodiment, showing the embodiment inverted relative to FIG. 2.

The fastening end portion 16 has a detent part 26, a spacer loop part 28, and a J-hook part 30. The spacer loop part 28 is smoothly curved in side elevation (FIG. 2) and provides a lateral offset (see FIG. 1) with respect to the detent part 26 of the J-hook part 30. The J-hook part 30 has a proximal leg portion **30*p*, a curved hook portion 30*h*, and a distal cam portion 30*c*, the hook portion 30*h* and the cam portion 30*c* being of a serpentine shape in lateral profile (FIG. 2). The hook portion 30*h*** is substantially arcuate, with a radius closely matching that of the reinforcing wire with which the spacer is to be used.

Figure 5A:
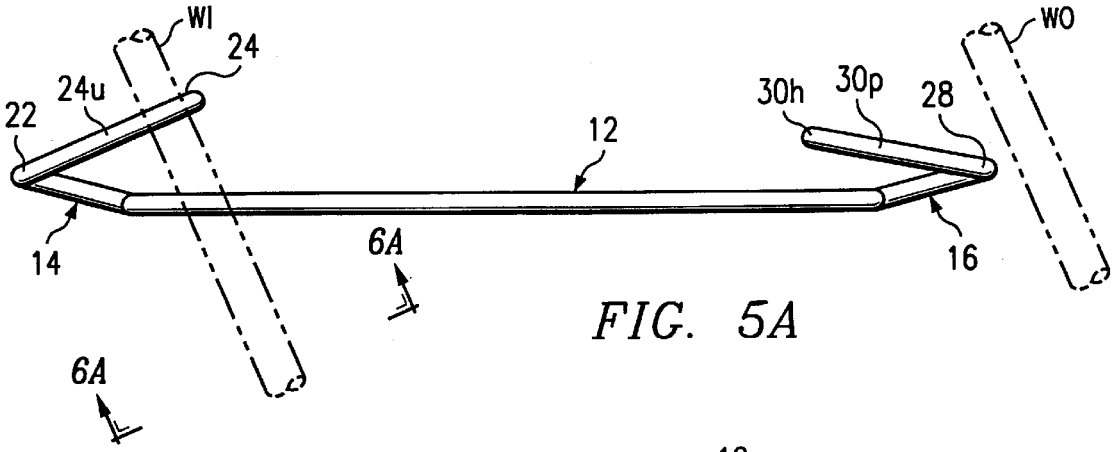
FIGS. 5A to 5D are top plan views, which show in sequence the positions of the spacer at certain stages of installing it to join two reinforcement wires.
Figure 6A:
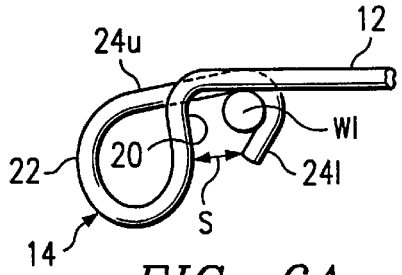
FIGS. 6A to 6D are end elevational views of the spacer and reinforcement wires at stages corresponding to those shown in FIGS. 5A to 5D.

The spacers 10 are used to join the inner reinforcement wire cage and the outer reinforcement wire cage at a predetermined spacing from each other and to position the inner and outer cages at the desired spacings from the inner and outer molds (the core and the jacket) into which the concrete for the box section or other precast structure is poured. Generally, the spacers are attached to the cages provided in a grid measuring two feet by two feet in all walls of the box section, each spacer joining a main circumferential wire of the inner cage to a main circumferential wire of the outer cage opposite from the wire of the inner cage. As installed, the spanning portion 12 of each spacer is perpendicular to the inner and outer surfaces of the wall of the box section. The cages are usually assembled around the mold core, the mold jacket, of course, being removed to allow the cages to be assembled. The spacers 10 are installed in the following way:

FIGS. 5A and 6A—The spacer is inserted through an opening in the wire reinforcement of the outer cage and oriented obliquely to a wire WI of the inner cage. The oblique orientation allows the hook end portion 14 to be dropped down over the wire WI by presenting the detent 20 and the V-hook 24 to the wire at angles that leave a space S (FIG. 6A) wide enough to accept the wire WI.

Figure 5B:
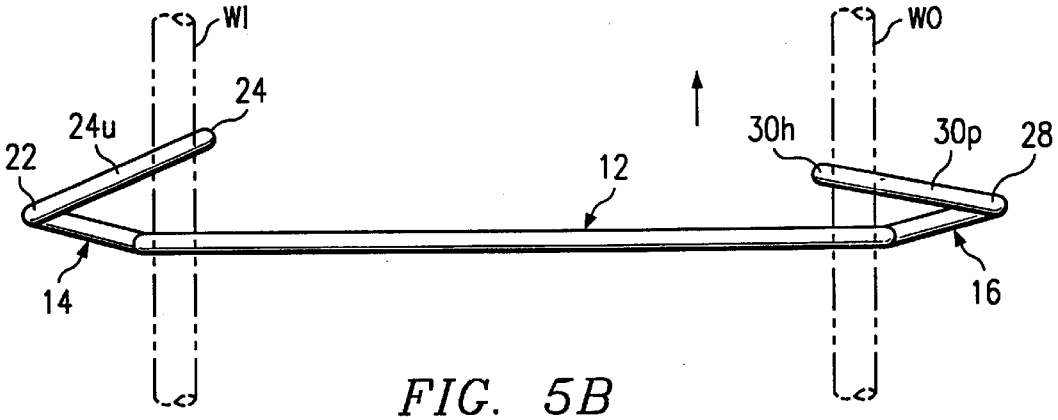
Figure 6B:
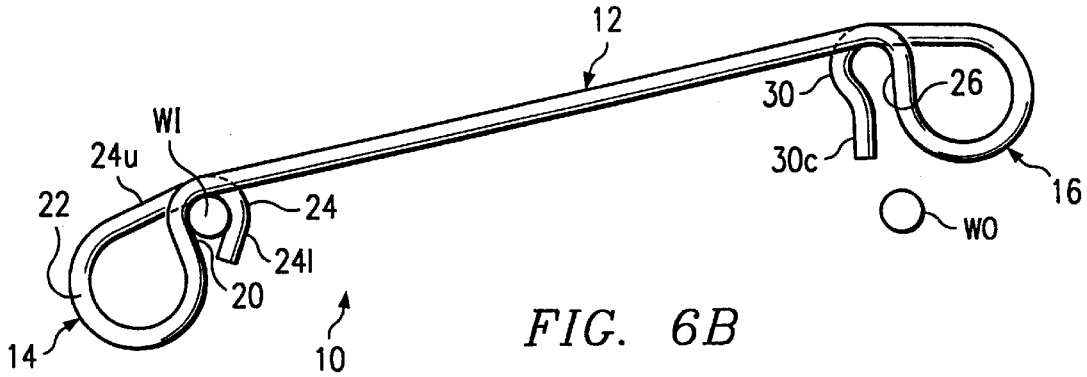

FIGS. 5B and 6B—The spacer is rotated about the hook end 14 (in the direction of the arrow) toward a position in which the spanning portion 12 lies generally perpendicular to the inner wire WI and the outer wire WO, as shown in FIGS. 5B and 6B. Depending on the thickness of the wire WI, the spacer may actually lie somewhat oblique to the wires WI and WO (in either direction relative to the perpendicular position shown), but is engaged firmly by the detent 20 and the V-hook 24. Further pivoting of the spacer in the direction of the arrow requires applying a force to the fastener end portion 16. The fastener end portion 16 is lifted up at this stage to clear the wire WO (FIG. 6B) since the fastener end portion cannot be pushed down onto the wire WO when in the illustrated position of FIGS. 5B and 6B.

Figure 5C:
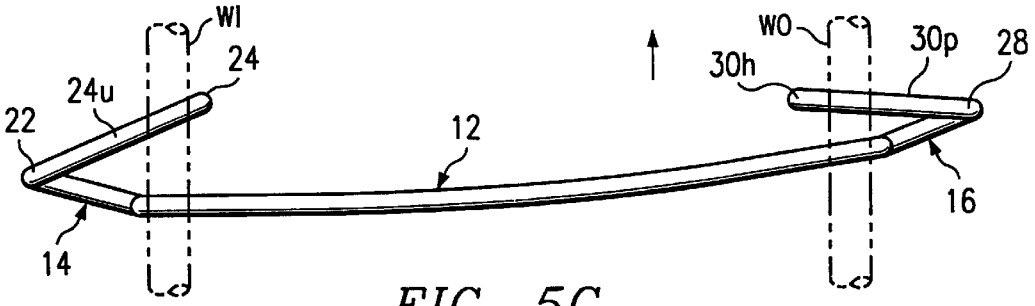
Figure 6C:
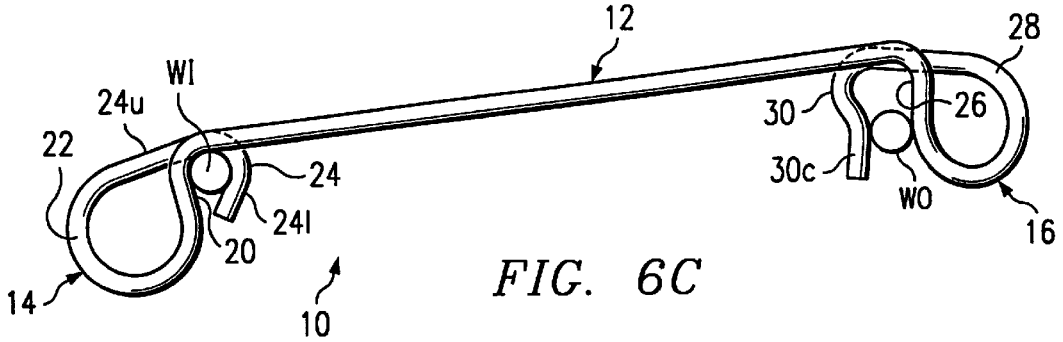

FIGS. 5C and 6C—The fastener end portion 16 is pushed from the position shown in FIGS. 5B and 6B, which requires applying several pounds of force by hand to the fastener end, thus pivoting the spacer about the hook end portion 14 somewhat beyond a position in which the spanning portion lies perpendicular to the wires WI and WO. Inasmuch as the wire WI is tightly engaged with the detent part 20 and the V-hook part 24, the position in these figures is attained only by bending of the spanning portion 12 and some resilient constriction of the spacer loop portion 14. When the spacer is in the position shown in FIGS. 5C and 6C, the fastener end 16 can by pushed down manually into place in engagement with the wire WO. The cam portion **30*c* of the J-hook part, working against the wire WO, forces the spacer loop part 28 of the fastener end portion 16 to constrict and, together with the favorable angling of the fastener portion to the wire WO, such as to present a wider space (in lateral profile, FIG. 6C) between the detent 26 and the J-hook that enables the wire WO to be accepted into the detent 26 and J-slot 30**.

Figure 5D:
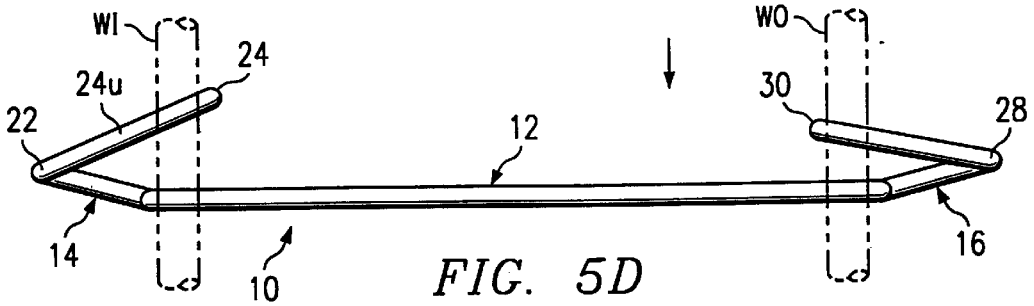
Figure 6D:
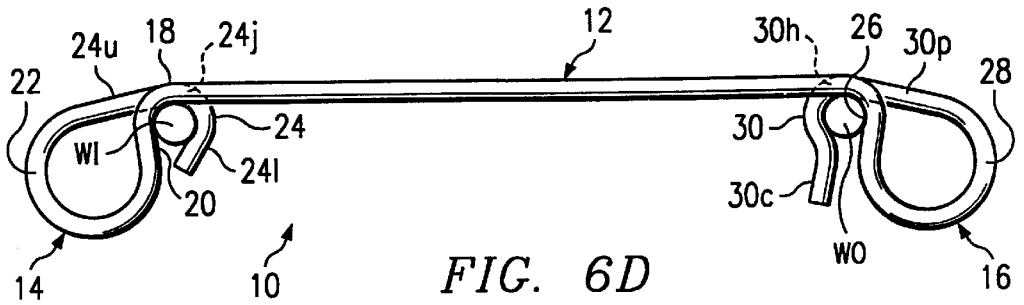

FIGS. 5D and 6D—Because attaining the position shown in FIGS. 5C and 6C requires deformation of the spacer—a combination of bending of the spanning portion 12 and constrictions of the spacer loops parts 22 and 28—the spacer tends to restore itself by resiling to a position in which the spanning portion is perpendicular to the wires WI and WO. The installer may have to slide the fastener end manually back to the perpendicular position. Once the installed position is reached (FIGS. 5D and 6D), the residual pre-stresses in the spacer loop portions 22 and 28 provide gripping forces between the detent parts 20 and 26 and the V-hook and J-hook parts 24 and 30 that frictionally hold the spacer in a lateral position. In the installed position of FIG. 5D and 6D, the spacer loops are somewhat constricted, relative to their relaxed (no load) states. Also, as may be observed in FIG. 6D, the following engagements ensure that the spacer cannot release from either wire WI or WO and that the desired spacing between the wires is maintained:

The detent part 20 of the V-hook end portion 14 engages upwardly, outwardly and downwardly facing portions of the wire WI of the inner wire reinforcement cage;

The detent part 26 of the fastener end portion 16 engages upwardly, outwardly and downwardly facing portions of the wire WO of the outer wire reinforcement cage;

The V-hook part 24 of the hook end portion 14 engages upwardly, inwardly and downwardly facing portions of the wire WI of the inner wire reinforcement cage; and The J-hook part 30 of the fastener end portion 16 engages upwardly, inwardly, and downwardly facing portions of the wire WO of the outer wire reinforcement cage.

Thus, the detent parts 20 and 26 keep the cage wires WI and WO from moving outwardly away from each other, and the hook parts 24 and 30 keep the cage wires from moving inwardly toward each other. The detent and hook parts of each end portion of the spacer, as viewed in elevation, present constricted throats, thus trapping the spacer against upward displacement away from the cage wires. The detent and hook parts overlie the cage wires and, of course, cannot be dislodged in a downward direction.

In most cases, the spacing between the outermost extremity of each cage reinforcement wire and the outermost extremity of the spacer loop portions 22, 28 associated with that cage reinforcement wire will correspond to the specified concrete cover over the welded wire reinforcement (see, for example, ASTM Designations C789-87 and C850-87), and the outermost extremity of each loop portion 22, 28 will engage one of the forms. It is also possible for only one of the spacer loop portions to engage only one form of the mold and to thereby function as a stirrup spacer for use in double cage reinforced round pipe as described above. The spacer is produced in a range of sizes to meet the specifications for the proper positioning and concrete cover of the wire reinforcement cage and their various gages for the precast concrete structures in which they are to be used.

Although the present invention and its advantages have been described in detail, it should be understood that various changes, substitutions and alterations can be made in the embodiment described above without departing from the spirit and scope of the invention as defined by the following claims.

What is claimed is:

1. A weldless spacer for connecting a first reinforcement wire and a second reinforcement wire in spaced-apart relation, the spacer being a unitary resilient wire member having an elongated spanning portion adapted to extend between the first and second reinforcement wires;

a hook end portion at one end of the spanning portion; and a fastening end portion at the other end of the spanning portion;

the hook end portion having a detent part curved to form a groove at a juncture with the spanning portion so as to engage upwardly, outwardly and downwardly facing surfaces of the first wire at a first location along the first wire, a V-hook part shaped and positioned to form a groove so as to engage upwardly, inwardly and downwardly facing surfaces of the first wire at a second location along the first wire spaced apart laterally to one side with respect to the spanning portion, and a loop part joining the detent part and the V-hook part; and the fastening end portion having a detent part curved to form a groove at a juncture with the spanning portion so as to engage upwardly, outwardly and downwardly facing surfaces of the second wire at a first location, a J-hook part shaped and positioned to form a groove so as to engage upwardly, inwardly and downwardly facing surfaces of the second wire at a second location along the second wire spaced apart laterally to said one side from said first location with respect to the spanning portion, and a loop part joining the detent part and the J-hook part.

2. A weldless spacer according to claim 1, wherein the J-hook part of the fastening end portion includes a serpentine end leg part forming a camming surface adapted to engage an inner surface of the second wire and facilitate reception of the second wire into the groove of the J-hook part.

3. A weldless spacer according to claim 1, wherein when the spacer is installed on the wires the V-hook part and detent part of the hook end portion form in profile a throat having an entrance that is narrower than the lateral thickness of the first wire.

4. A weldless spacer according to claim 1, wherein when the spacer is installed on the wires the J-hook part and detent part of the fastening end portion form in profile a throat having an entrance that is narrower than the lateral thickness of the second wire.

5. A weldless spacer according to claim 1, wherein the V-hook part of the hook end portion has first and second legs forming an angle of from about 30 degrees to about 60 degrees and a rounded portion joining the legs.

6. A weldless spacer according to claim 1, wherein the loop part of the hook end portion is substantially arcuate in profile.

7. A weldless spacer according to claim 1, wherein the loop part of the fastening end portion is substantially arcuate in profile.

8. A weldless spacer according to claim 1, wherein when the weldless spacer is installed on the wires the loop portions are resiliently stressed in bending so as to frictionally engage the grooves with the wires and retain the spacer against displacement along the wires.

9. A weldless spacer for connecting a first reinforcement wire and a second reinforcement wire of a steel reinforcing system of a reinforced concrete structure in spaced-apart relation, the spacer being a unitary resilient wire member having an elongated spanning portion adapted to extend between the first and second reinforcement wires;

a hook end portion at one end of the spanning portion; and a fastening end portion at the other end of the spanning portion;

the hook end portion having a detent part curved to form a groove at a juncture with the spanning portion, the groove being shaped to engage upwardly, outwardly and downwardly facing surfaces of the first wire at a first location along the first wire, a V-hook part shaped and positioned to form a groove so as to engage upwardly, inwardly and downwardly facing surfaces of the first wire at a second location along the first wire spaced apart laterally to one side with respect to the spanning portion, and a smoothly curved loop part joining the detent part and the V-hook part; and the fastening end portion having a detent part curved to form a groove at a juncture with the spanning portion, the groove being shaped to engage upwardly, outwardly and downwardly facing surfaces of the second wire at a first location, a J-hook part shaped and positioned to form a groove so as to engage upwardly, inwardly and downwardly facing surfaces of the second wire at a second location along the second wire spaced apart laterally to said one side with respect to the spanning portion, and a smoothly curved loop part joining the detent part and the J-hook part, and the J-hook part of the fastening end portion including a serpentine end leg part forming a distal camming surface adapted to engage an inner surface of the second wire and facilitate reception of the second wire into the detent part and the groove of the J-hook part.

10. A weldless spacer according to claim 9, wherein when the spacer is installed on the first and second wires the V-hook part and detent part of the hook end portion form in profile a throat having an entrance that is narrower than the lateral thickness of the first wire.

11. A weldless spacer according to claim 9, wherein when the spacer is installed on the first and second wires the J-hook part and detent part of the fastening end portion form in profile a throat having an entrance that is narrower than the lateral thickness of the second wire.

12. A weldless spacer according to claim 9, wherein the V-hook part of the hook end portion has first and second legs forming an angle of from about 30 degrees to about 60 degrees and a rounded portion joining the legs.

13. A weldless spacer according to claim 9, wherein the loop part of the hook end portion is substantially arcuate in profile.

14. A weldless spacer according to claim 9, wherein the loop part of the fastening end portion is substantially arcuate in profile.

15. A weldless spacer according to claim 9, wherein when the weldless spacer is installed on the first and second wires the loop parts are resiliently stressed in bending so as to frictionally engage the grooves with the wires and retain the spacer against displacement along the wires.

16. A weldless spacer according to claim 9, wherein the outermost extremity of at least one of the loop parts of the spacer is adapted to engage one form of a mold in which the concrete structure is made so as to position the reinforcing system in a predetermined position in the mold.

17. A weldless spacer according to claim 9, wherein the outermost extremity of each of the loop parts of the spacer is adapted to engage one form of a mold in which the concrete structure is made so as to position the reinforcing system in a predetermined position in the mold.

* * * * *

UNITED STATES PATENT AND TRADEMARK OFFICE

CERTIFICATE OF CORRECTION

PATENT NO. : 5,896,722

DATED : April 27, 1999

INVENTOR(S) : Richard A. Swenson

It is certified that error appears in the above-identified patent and that said Letters Patent is hereby corrected as shown below:

On the title page, under item [56], References Cited, U.S. PATENT DOCUMENTS :

"3,722,164 3/1973 Schmiogall" should read --3,722,164 3/1973 Schmidgall--;

On the title page, under item [56], References Cited, OTHER PUBLICATIONS :

"Catalog for Spacers and Reinforcement Accessories for Concrete Products," should read -- Catalog for "Spacers and Reinforcement Accessories for Concrete Products", — --;

Col. 1, line 10, "sewers double" should read --sewers, double--;

Col. 5, line 31, "30 degrees" should read --30 degrees, --.

Signed and Sealed this

Seventh Day of December, 1999

*Attest:*

Q. TODD DICKINSON

*Attesting Officer*

*Acting Commissioner of Patents and Trademarks*